US009751023B2

(12) United States Patent
Kette

(10) Patent No.: US 9,751,023 B2
(45) Date of Patent: Sep. 5, 2017

(54) MODULAR, RECONFIGURABLE, AQUATIC DEVICE AND METHOD OF MANUFACTURE

(71) Applicant: RAIN DROP PRODUCTS, LLC, Ashland, OH (US)

(72) Inventor: Ross Kette, Sandusky, OH (US)

(73) Assignee: RAINDROP PRODUCTS, LLC, Ashland, OH (US)

( * ) Notice: Subject to any disclaimer, the term of this patent is extended or adjusted under 35 U.S.C. 154(b) by 0 days.

(21) Appl. No.: 14/777,303

(22) PCT Filed: Mar. 17, 2014

(86) PCT No.: PCT/US2014/030439

§ 371 (c)(1),
(2) Date: Sep. 15, 2015

(87) PCT Pub. No.: WO2014/145639

PCT Pub. Date: Sep. 18, 2014

(65) Prior Publication Data

US 2016/0016084 A1 Jan. 21, 2016

Related U.S. Application Data

(60) Provisional application No. 61/794,684, filed on Mar. 15, 2013.

(51) Int. Cl.
*A63G 31/00* (2006.01)

(52) U.S. Cl.
CPC ..... *A63G 31/007* (2013.01)

(58) Field of Classification Search
CPC ..... A63G 31/007
See application file for complete search history.

(56) References Cited

U.S. PATENT DOCUMENTS

| | | | | |
|---|---|---|---|---|
| 4,416,420 | A | 11/1983 | Thompson | |
| 4,557,210 | A * | 12/1985 | Gerwin | B63B 1/121 114/357 |
| 5,194,048 | A | 3/1993 | Briggs | |
| 5,503,597 | A * | 4/1996 | Lochtefeld | A63G 21/18 4/904 |
| 5,967,901 | A | 10/1999 | Briggs | |
| 6,319,139 | B1 * | 11/2001 | Tracy | A63B 71/02 472/117 |
| 6,702,687 | B1 | 3/2004 | Henry | |
| 6,739,979 | B2 | 5/2004 | Tracy | |
| 8,021,239 | B2 | 9/2011 | Weston et al. | |
| 8,226,493 | B2 | 7/2012 | Briggs et al. | |
| 2002/0074427 | A1 | 6/2002 | Ericksen et al. | |

OTHER PUBLICATIONS

PCT/US2014/020439 International Search Report and Written Opinion, mailed Aug. 28, 2014.

* cited by examiner

*Primary Examiner* — Michael Dennis
(74) *Attorney, Agent, or Firm* — Fay Sharpe LLP

(57) ABSTRACT

A water play apparatus and associated method of manufacturing the water play apparatus includes a hollow, rigid endoskeleton having a fluid passage formed therethrough. An exoskeleton is received around the endoskeleton and formed from a material (foam) different and less rigid than the endoskeleton (rigid pipe or tube), and a hardener or a polymer skin is received over the exoskeleton.

21 Claims, 25 Drawing Sheets

MODULAR, RECONFIGURABLE, AQUATIC DEVICE AND METHOD OF MANUFACTURE

BACKGROUND

This disclosure relates to water play equipment with dynamic, custom-designed waterworks, sometimes referred to as spray grounds or water parks.

One preferred manner of manufacturing water play equipment uses a fiberglass and mat construction to form a desired shape. The molded components are trimmed and structural adhesive is used to bond the parts together. A filament wound or fiberglass pipe is often used, and the pipe is inserted into purchased flanges. Larger bent pipes or domes are typically outsourced products. The water is distributed through the water feature by either flooding the fiberglass outer pipe or hose(s) inside the fiberglass outer pipe.

It becomes necessary to hide or disguise the seams between separately molded components. The assembly is primed, and all the pin holes are filled, as is common when working with fiberglass. A body fill material is then applied, the surface is scuffed, and then primed again. Subsequently, nozzles, sensors, internal plumbing, etc. are installed. The assembly is wrapped, crated, and shipped to its final destination for installation on-site. This is, unfortunately, the conventional manner of creating customized shapes and is a labor intensive manufacturing process to achieve these customized shapes. Also, the assemblies are often quite large and thus expensive to ship in an assembled state.

Other manufacturers start with a stainless steel pipe, and then bend the pipe to a desired shape. Again, the process is labor intensive and still results in large components that are expensive to ship. However, the ability to make customized shapes is substantially unavailable since the final structure is limited to the shape of the pipes. For example, boats, animals, slides, plants, creative characters, fire hydrants, domes, creature features, showers, water jets, dumping troughs and buckets, water curtains, misting areas (any or all of which may include integrated lights and/or integrated sounds), etc. have external surfaces that often are not conducive to being made with tubular or pipe-like shapes or configurations, and thus the tubular/pipe-like shapes severely limit the surface configuration of final components.

Consequently, a need exists for a simpler manufacturing process, particularly one that does not require as much skill, to form a wide array of external shapes that convey water through an inner passage. An added benefit is desired in order to easily assemble individual components one to the other (particularly after shipping), thereby reducing shipping costs, ease of final assembly, and the ability to mix and match different parts for initial assembly as well as repair and replacement.

SUMMARY

A water play apparatus, and the associated manufacturing method, includes a hollow, rigid endoskeleton having a fluid passage formed therethrough, and an exoskeleton received around the endoskeleton and formed from a material different and less rigid than the endoskeleton. The polymer skin is received over the exoskeleton.

The rigid endoskeleton includes a hollow pipe, and preferably stainless steel pipe.

The exoskeleton includes a hollow foam received over the pipe.

The foam includes preformed hollow foam segments.

The foam includes polystyrene.

The polymer skin includes at least one of polyurethane and polyethylene.

The endoskeleton includes plural segments joined in watertight sealed relation.

The endoskeleton segments each include a male joining component at a first end and a female joining component at a second end.

The first and second ends of the endoskeleton segments each include threaded regions for mechanically interconnecting adjacent segments.

An interior surface of the exoskeleton abuts against an exterior surface of the endoskeleton.

The interior surface of the exoskeleton abuts against the exterior surface of the endoskeleton along at least an entire length of the endoskeleton above ground.

The polymer skin is colored.

The first end of the endoskeleton is secured to a base.

At least one outlet extends through the exoskeleton in the polymer skin in fluid communication with the fluid passage in the endoskeleton.

The exoskeleton and the polymer skin are formed from non-corrosive materials.

The exoskeleton and the polymer skin form a nonconductive thermal and electrical barrier.

The exoskeleton is variable in shape along a length of the endoskeleton.

The exoskeleton is an elastomer or polymer molded to and completely encapsulating the endoskeleton.

At least one of a control sensor, valve, spray orifice, nozzle, camera, and sound device is incorporated in the apparatus.

One benefit of the present disclosure is the ease with which modular, reconfigurable water play apparatus can be manufactured, as well as a wide array of final configurations that are more complex than prior arrangements.

Another advantage is the reduced time required to manufacture the water play apparatus.

Still another benefit is the reduced cost to manufacture the water play apparatus.

Yet another advantage is associated with the reduced cost to ship components of the water play apparatus, and the ability to easily assembly components at the water park.

Other benefits and advantages will become apparent to those skilled in the art after reading and understanding the following detailed description.

DETAILED DESCRIPTION

Manufacturing methods and reconfigurable water play apparatus or elements are comprised of a plurality play element options, whereby the end user or participant may elect to change the water feature to a new shape or configuration. The elements comprise a water conveying internal or endoskeletal frame, encased in an exoskeletal composite shell. This arrangement of an internal water-carrying frame encased in a surrounding shell can also be made in various shapes and different segments that interconnect to form an infinite number of configurations that convey water to various water nozzles and outlets to form a large number of water effects, all of which alter the overall appearance of the water play apparatus.

Figure 1:
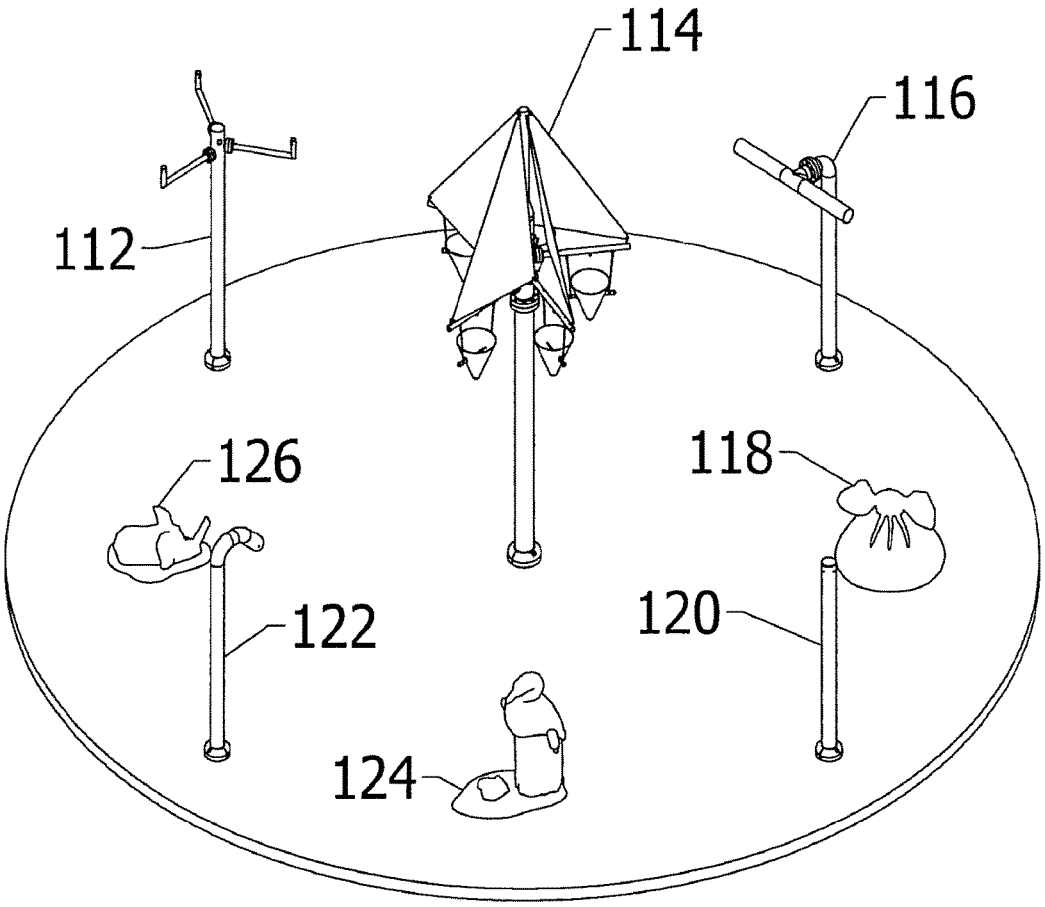
FIG. 1 shows a water park that includes various water play apparatus.

As shown in FIG. 1, a water park 100 includes a wide array of different, individual water play apparatus 112, 114, 116, 118, 120, 122, 124, 126. A water supply (not shown) provides water to a pump and underground passages for fluid communication with the various play apparatus 112-126. Water is also collected and typically recirculated to the water supply, details of which are conventional and well understood by those skilled in the art. The water park 100 may include timers or one or sensors that determine the on-off condition of the water board, and/or individual water play apparatus within the water park.

Figure 2:
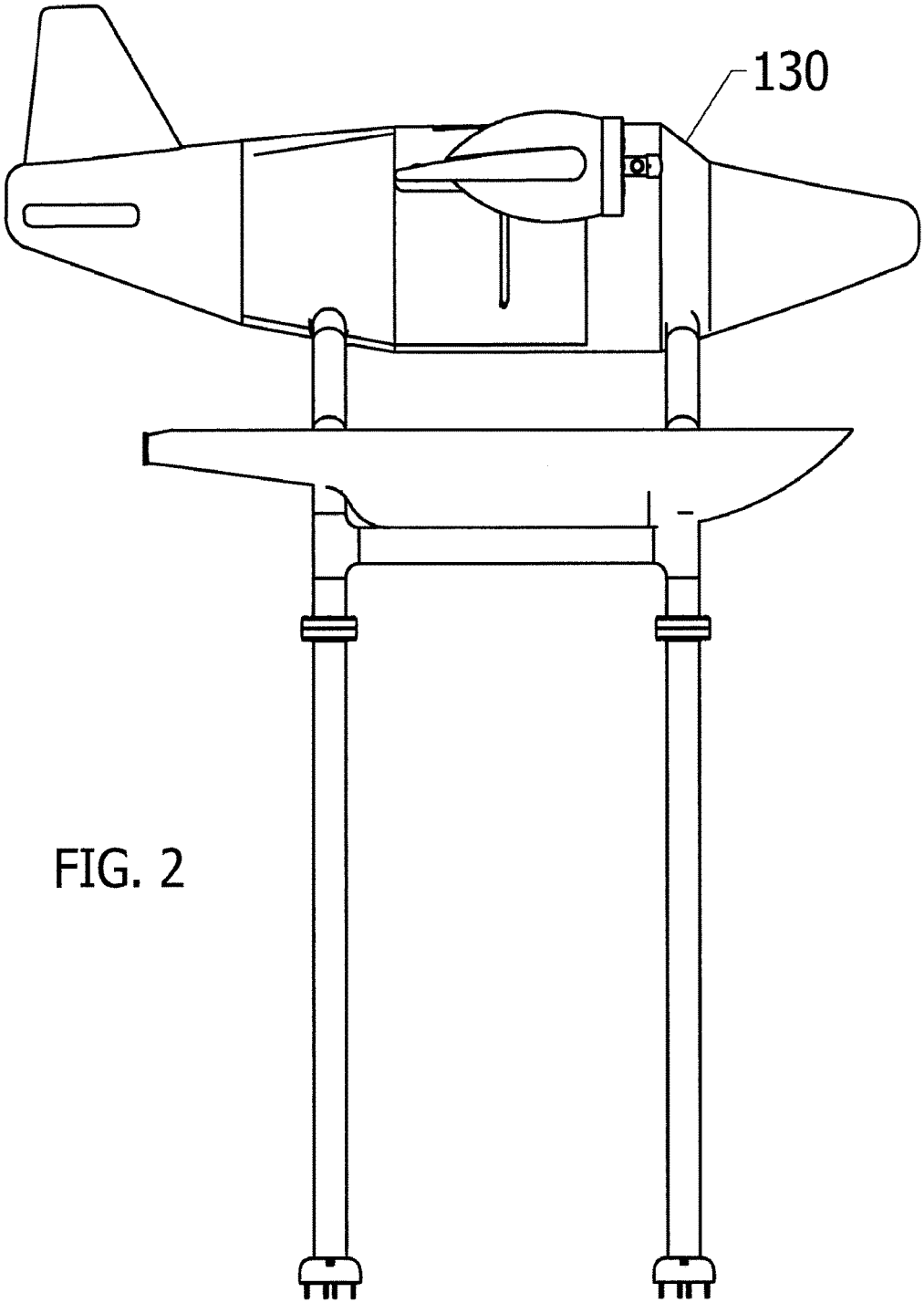
FIGS. 2-4 illustrate a wide array of dissimilar water play apparatus that can be manufactured in accordance with the present disclosure.
Figure 3:
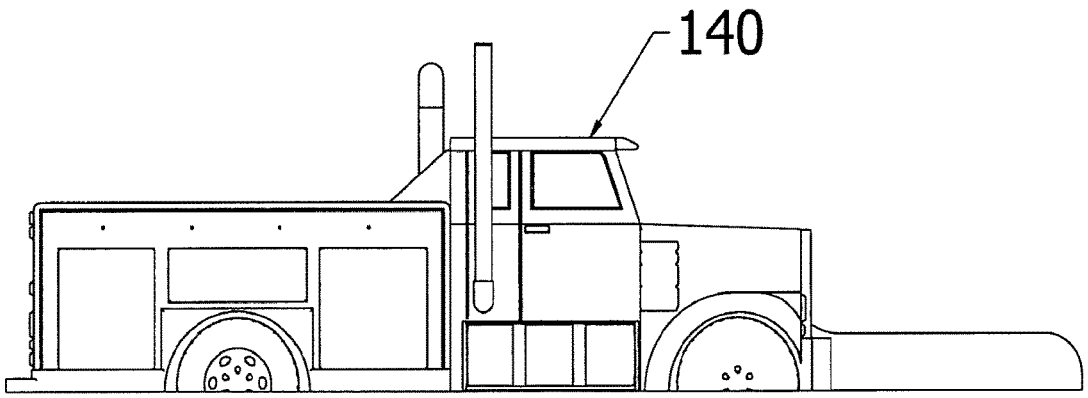
Figure 4:
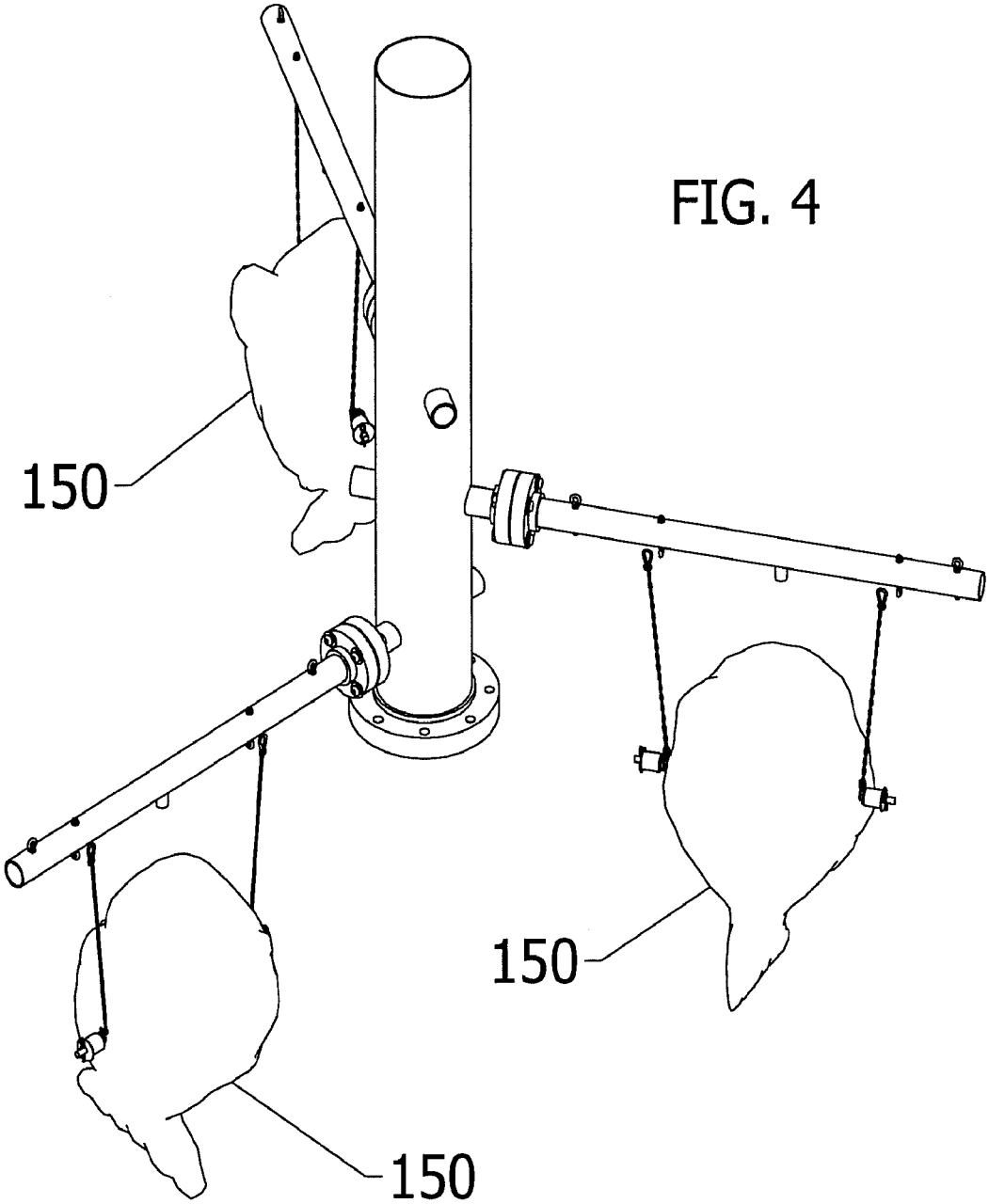
Figure 5A:
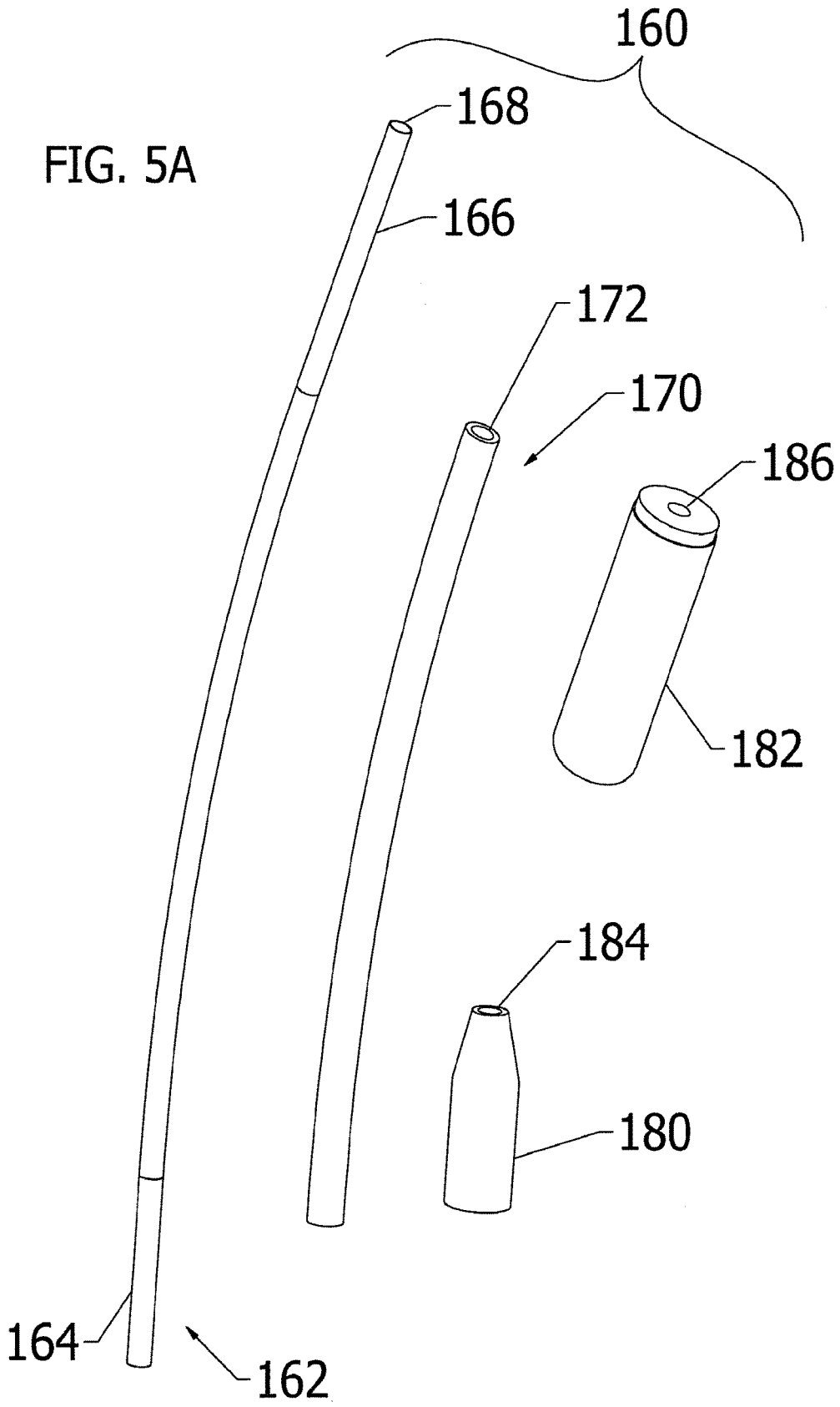
FIG. 5 shows individual components or pieces that are assembled into a water play apparatus.
Figure 5B:
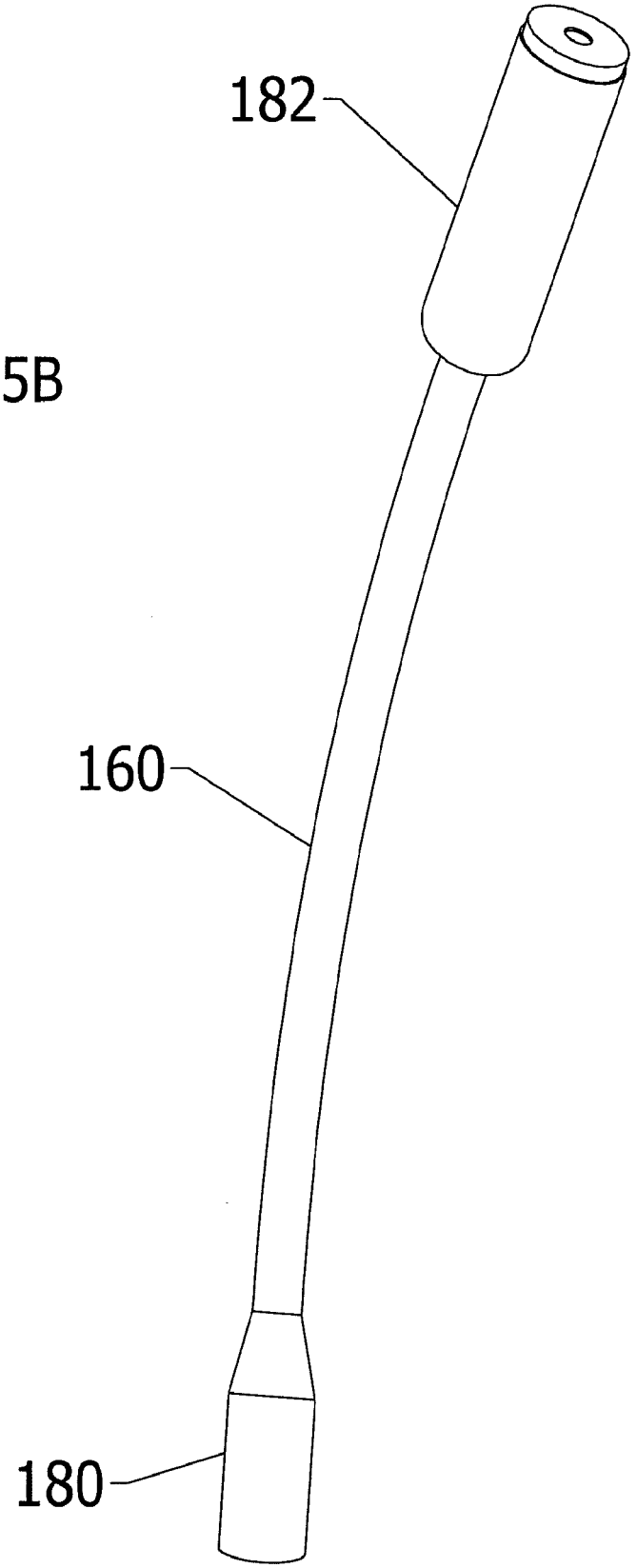
Figure 5C:
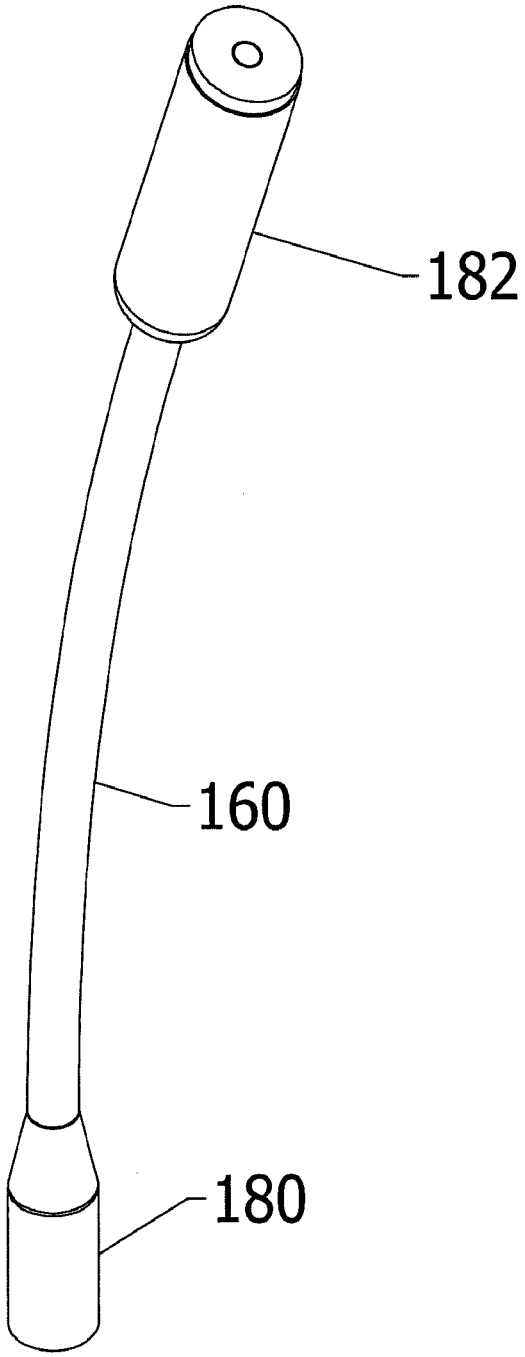
Figure 5D:
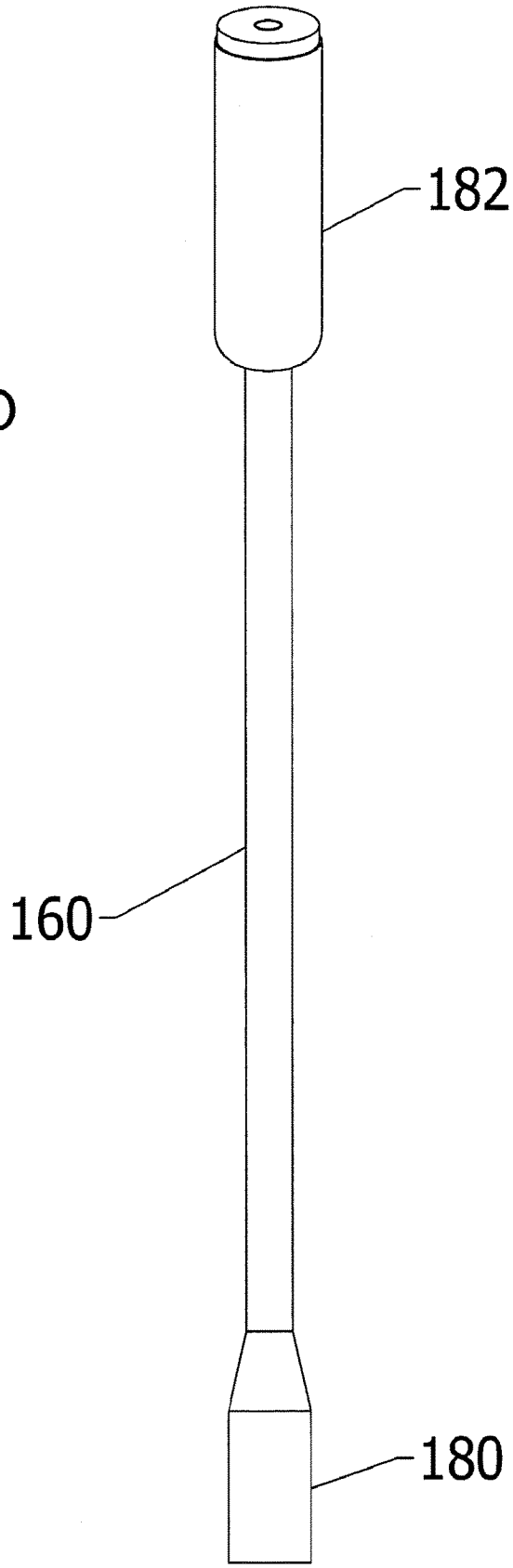
Figure 5E:
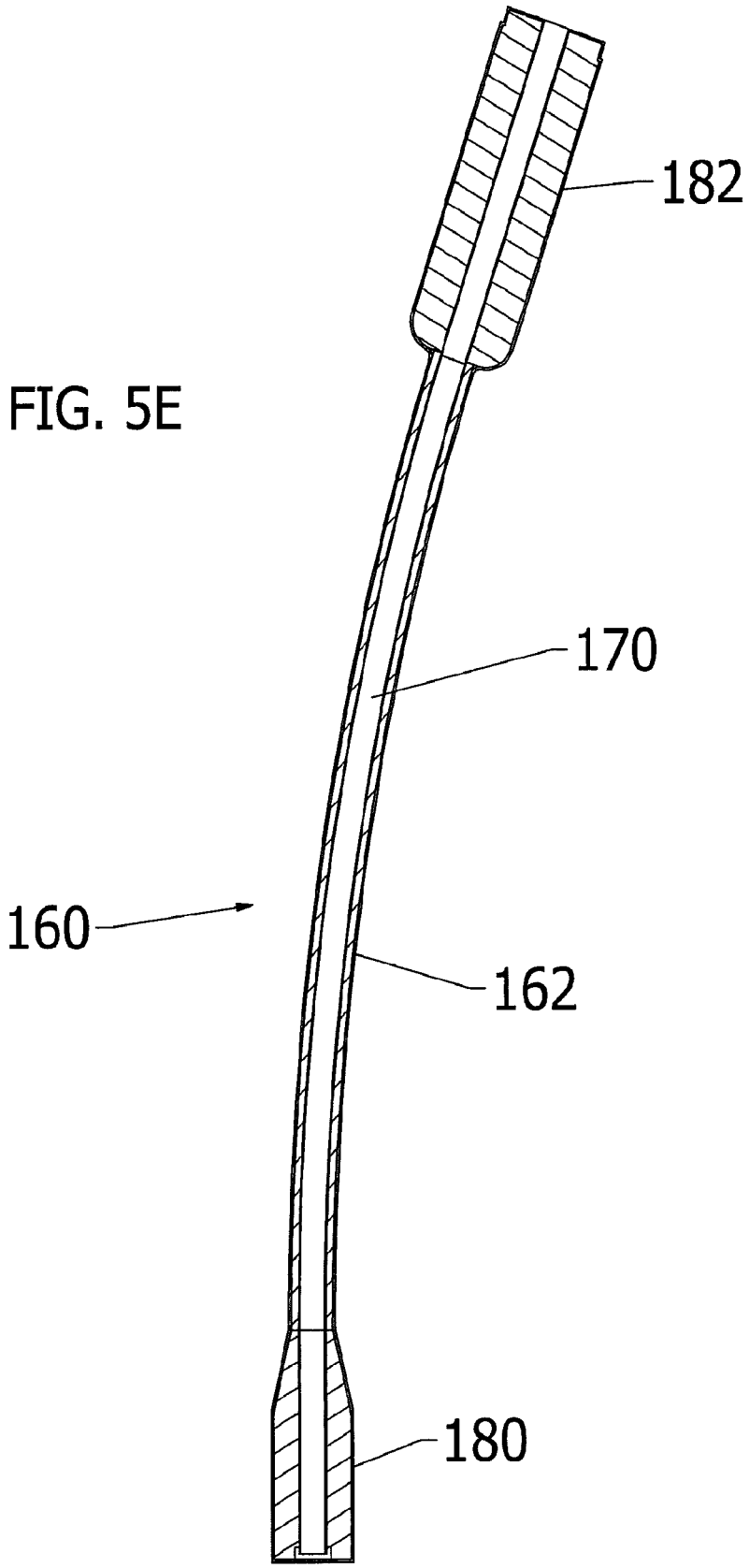
Figure 5F:
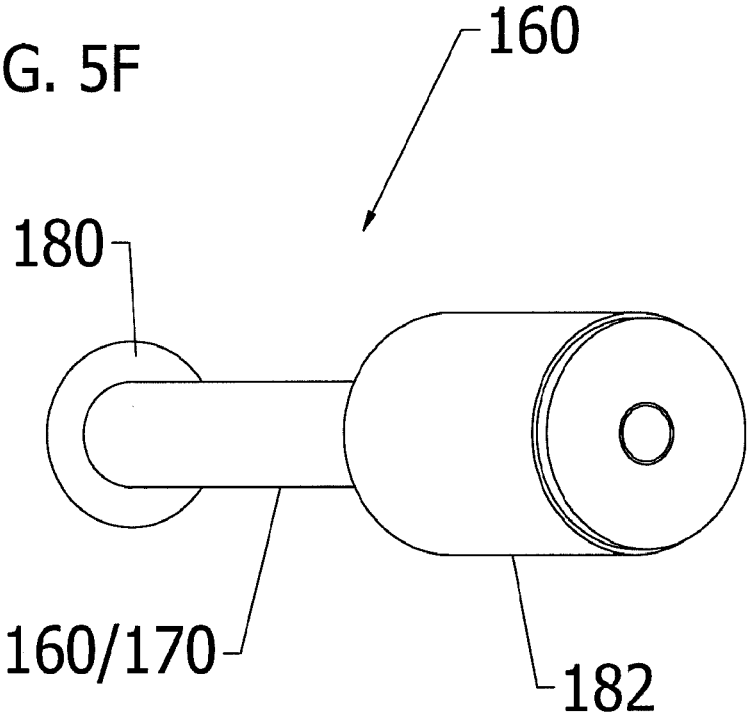
Figure 6A:
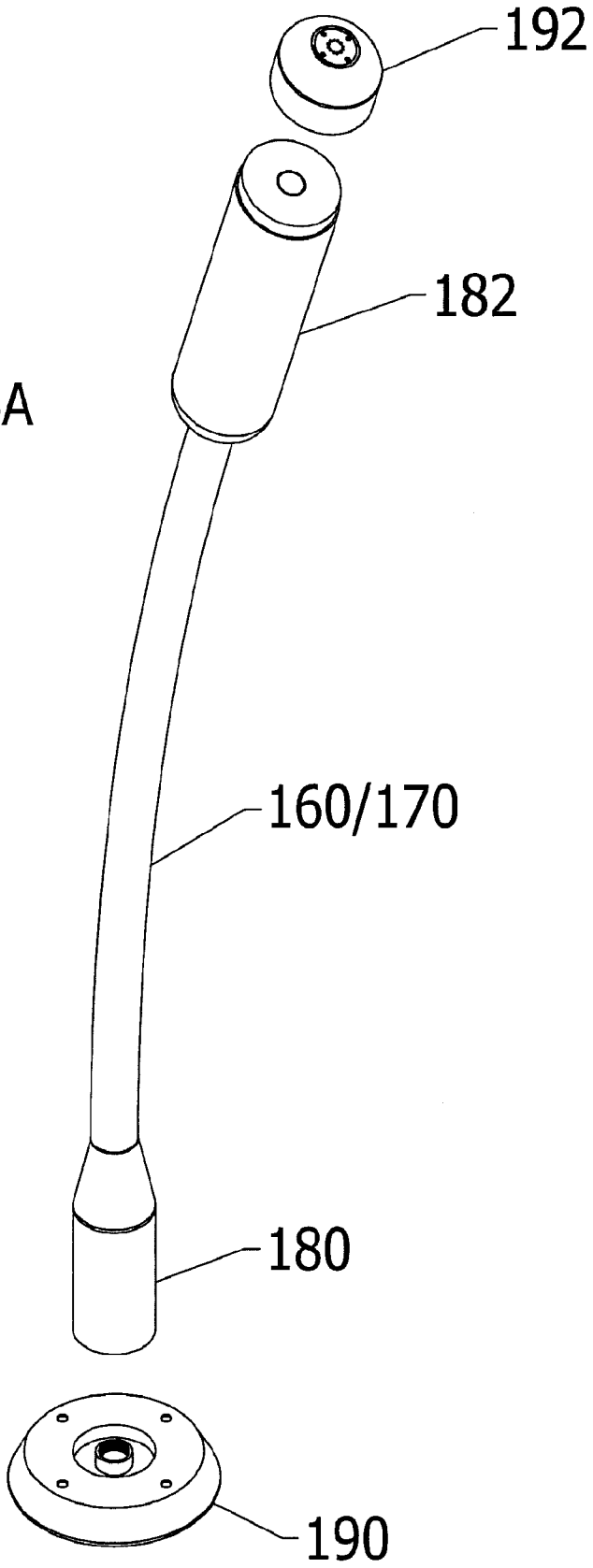
FIG. 6 shows additional assembly steps of the water play apparatus of FIG. 5.
Figure 6B:
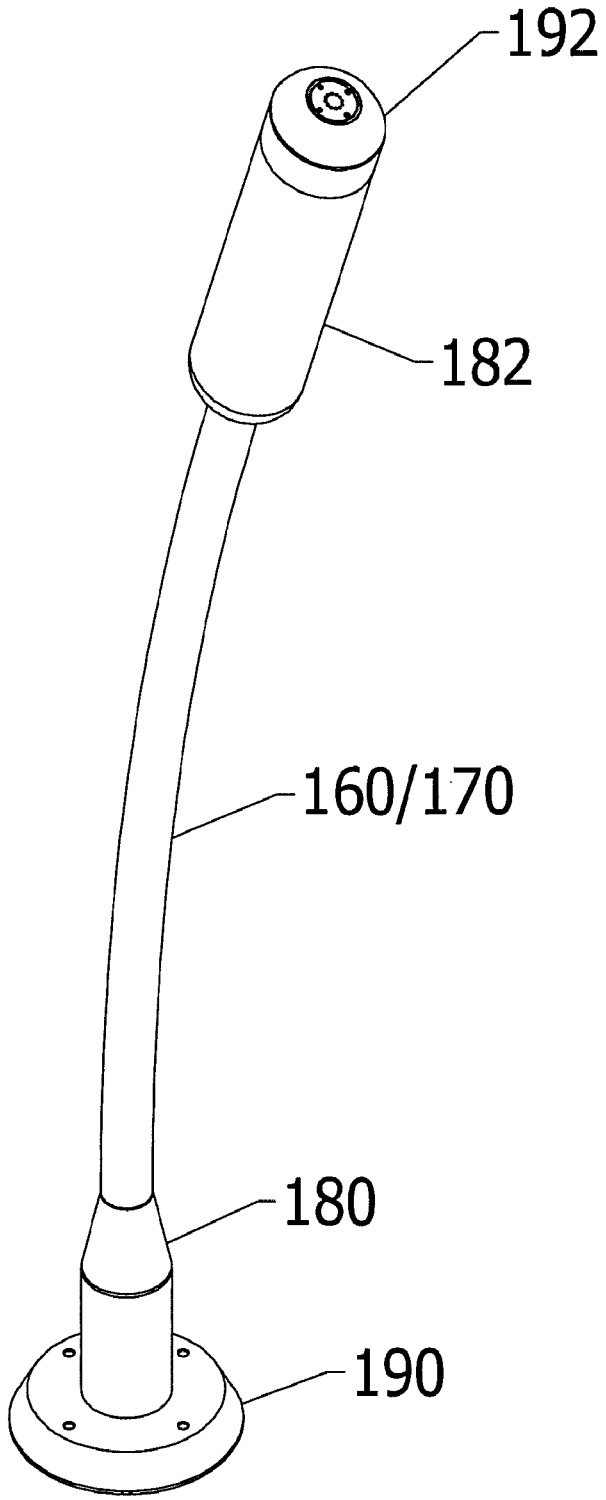
Figure 6C:
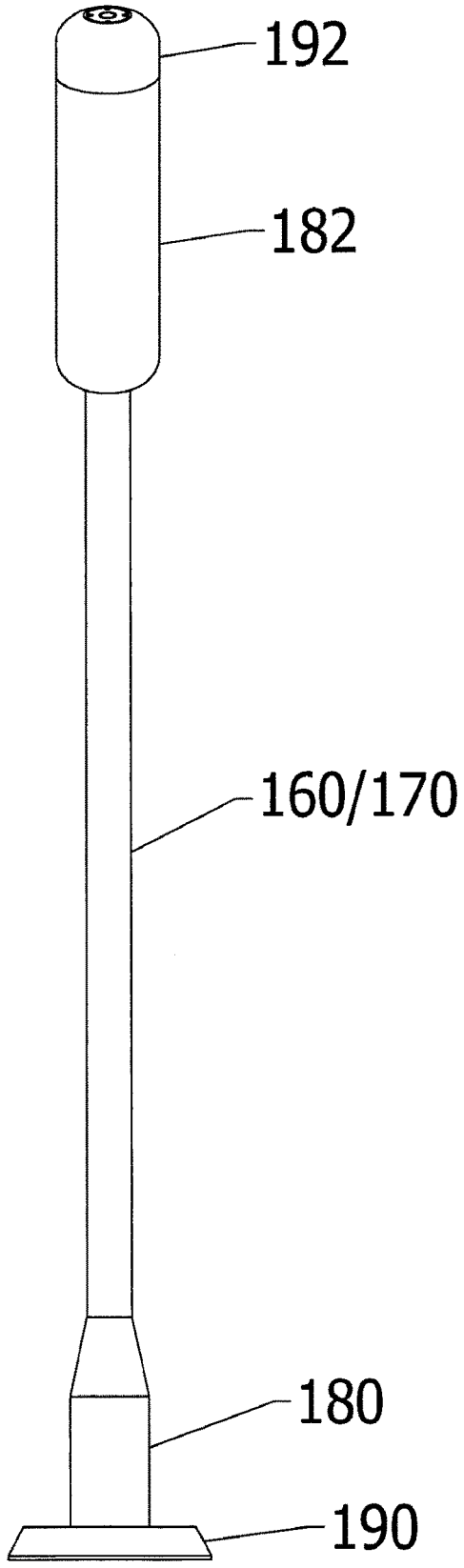
Figure 6D:
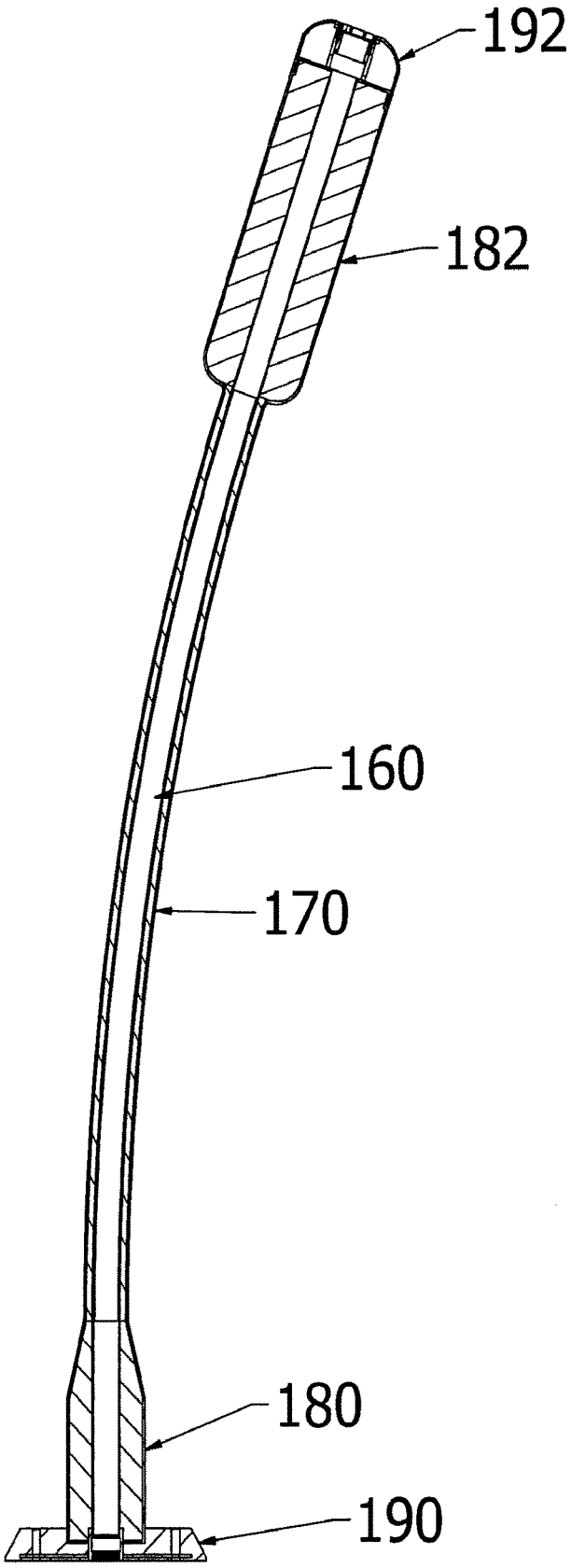
Figure 6E:
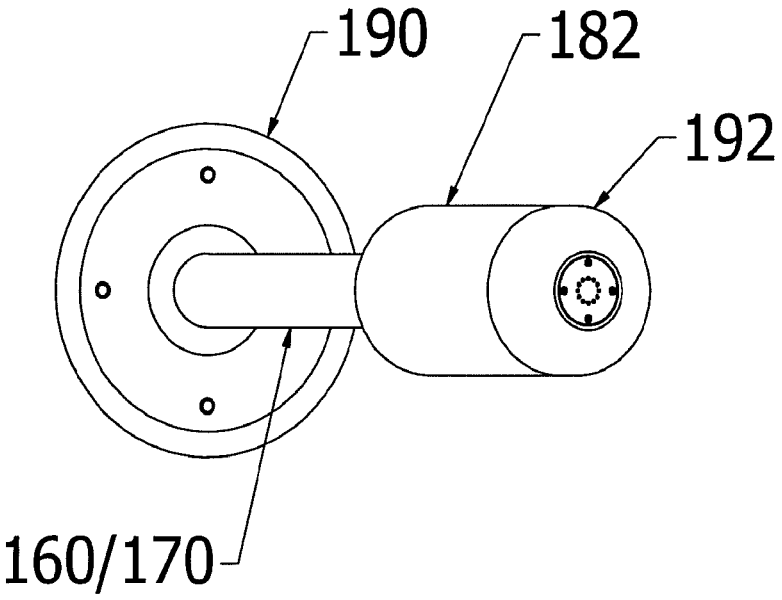
Figure 7A:
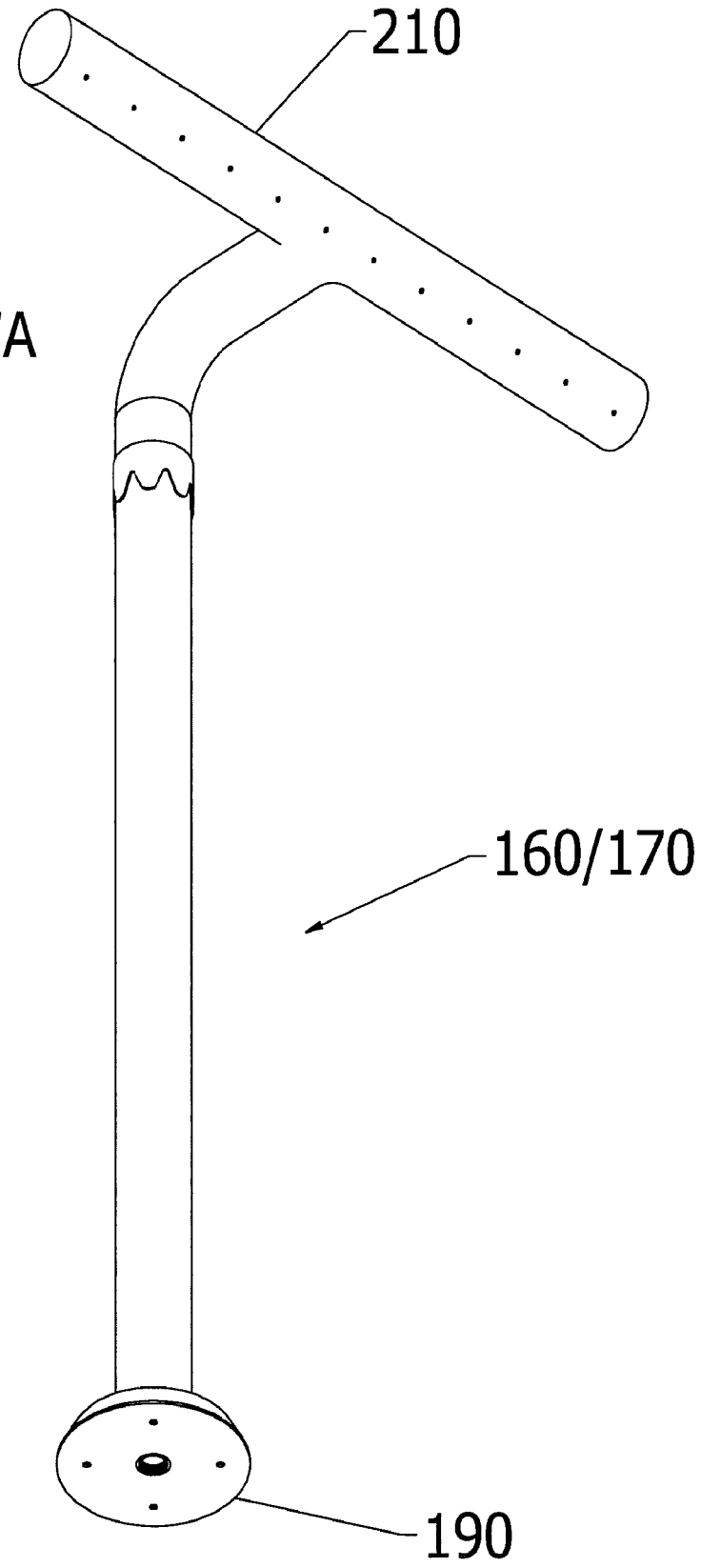
FIG. 7 shows individual components or pieces that are assembled into a water play apparatus.
Figure 7B:
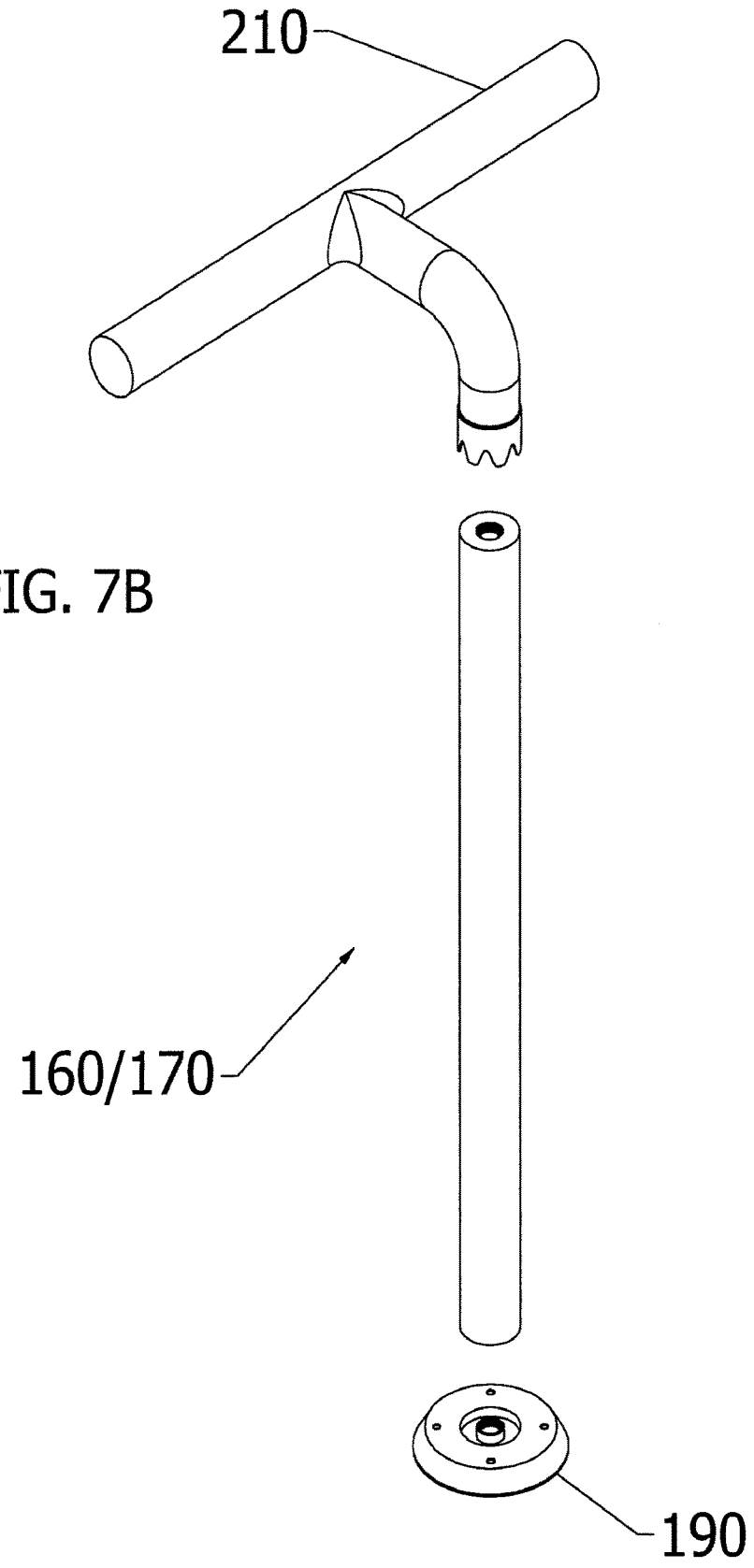
Figure 7C:
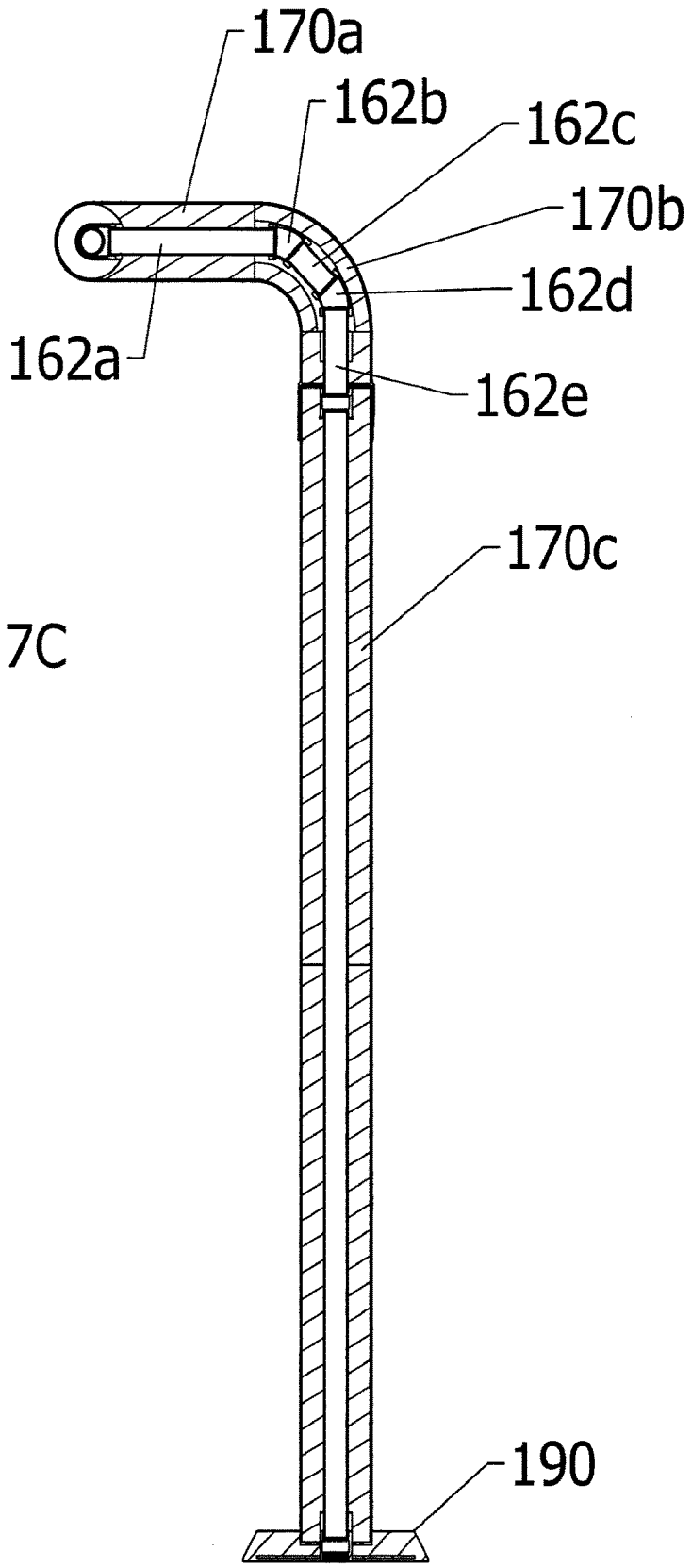
Figure 7D:
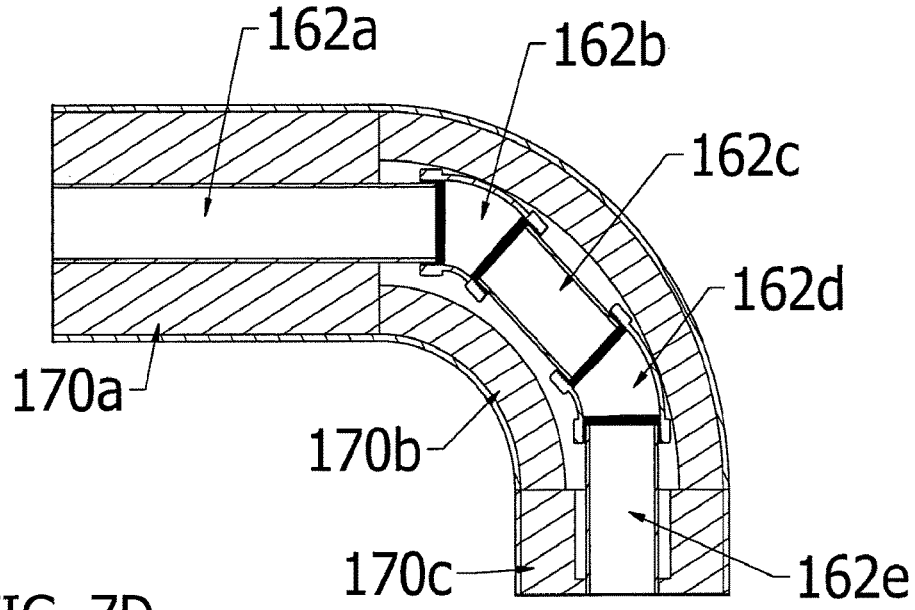

As noted in the Background, many known water play apparatus have relatively simple shapes dictated by the need to use rigid pipe in their structure. For example, water play apparatus 112, 114, 116, 120, 122 are exemplary configurations that have elongated, linear tubular conformations or bent tubular configurations. On the other hand, more complex shapes such as the water play apparatus 118, 124, 126 in FIG. 1, as well as additional complex shapes 130, 140, and 150 as illustrated in FIGS. 2-4 represent other creative play apparatus, e.g., plane 130 (FIG. 2), fire truck 140 (FIG. 3), and fish 150 (FIG. 4). Again, and as described in the Background, the complex shapes of FIGS. 2-4 are highly labor intensive to manufacture in accordance with known manufacturing methods. Further, the more complex shapes shown in FIGS. 1-4 are not intended to be the only such shapes that may be manufactured under either prior manufacturing methods or in accordance with the present disclosure, but are merely exemplary, more complex water play apparatus.

FIG. 5 illustrates the features of the present disclosure. More specifically, a water play apparatus 160 having a fluid passage includes an inner, hollow, rigid endoskeleton such as a hollow tube, pipe, or core 162 that has a first or lower end 164 and a second or upper end 166. Typically, the endoskeleton 162 is a stainless steel hollow rigid pipe structure that is generally non-corrosive, and provides strength and rigidity to the final water play apparatus as will become more apparent from the further description below. The pipe 162 has an inner opening or passage 168 therein, and that preferably extends in the illustrated embodiment through a major length or the entire length of the endoskeleton or pipe. Thus, the passage 168 is in fluid communication at the first end 164 with pressurized water conveyed, for example, from underground passages in the water park 100, and in fluid communication at the second end 166 with an outlet(s), nozzle(s), jet(s), etc., of the water play apparatus 160 (and which may vary depending on the configuration and desired water emission from the water play apparatus).

Intermediate the first and second ends 164, 166 of the endoskeleton or hollow pipe 162 is received an exoskeleton or hollow sleeve 170 that is formed from a material different from, and less rigid than, the endoskeleton 162. In one embodiment, the exoskeleton 170 is formed from preformed components such as a hollow sleeve configuration shown in FIG. 5 where an inner diameter or passage 172 is received on the outer diameter of the exoskeleton/pipe 162. For example, the exoskeleton 170 may be preformed foam component(s) that provide(s) a protective, force attenuating material over the rigid endoskeleton. One preferred preformed foam material is a polystyrene, although still other materials may be used without departing from the scope and intent of the present disclosure. Although the preformed foam material 170 of the exoskeleton is shown as a hollow, constant thickness structure along its length in FIG. 5, it is contemplated that the exoskeleton 170 may have a wide variety of shapes or configurations and that such shapes/configurations are particularly conducive to the final shape of the water play apparatus (e.g., 112, 114, 116, 118, 120, 122, 124, 126, 130, 140, or 150).

As is also evident in FIG. 5, the exoskeleton 170 may include one or more additional preformed components such as foam members 180, 182. The foam members 180, 182 are preferably a preformed shape, and have inner openings 184, 186, respectively, for receipt on the outer diameter of the exoskeleton/pipe 162. Again, these foam numbers 180, 182 preferably formed from a material different and less rigid than the endoskeleton 162 to provide a force attenuation and protection for users of the water park 100. Again, the foam members 180, 182 are shown received over the first and second ends 164, 166, respectively, of the endoskeleton 162. In addition, the foam members 180, 182 cooperate with the foam member 170 to provide complete coverage over the entire length of the rigid pipe of the endoskeleton 162. It is also evident in FIG. 5 that the final assembly of the rigid endoskeleton 162 with one or more exoskeleton components 170, 180, 182 received thereover could also be linear, bent, etc. depending on the final desired shape.

With continued reference to FIG. 5, and additional reference to FIG. 6, the water play apparatus is secured to the ground surface of the water park, for example, via a flange 190. As will be appreciated, the first end 164 of the rigid endoskeleton 162 is securely mounted to the flange 190 to provide the desired strength and rigidity of the water play apparatus. In addition, a dome 192 may be included at the second end 166/180 and cut or modified to accommodate a spray nozzle (not shown).

A skin 200 is preferably received over the endoskeleton/exoskeleton assembly. For example, the skin 200 is preferably a durable, non-corrosive material such as a thin polymer layer that completely encases the foam components of the exoskeleton and endoskeleton. The polymer skin 200 may include a dye to provide a desired end color, or formed from a material that can be easily painted. The polymer skin 200 also provides a smooth continuous surface over the assembly that hides all of the seams between the assembled components. The polymer skin 200 is, for example, a polyurethane, polyethylene or combination of these materials or similar materials that provide a smooth, sealed, watertight outer surface.

FIG. 7 (FIGS. 7A-7F) and 8 (FIGS. 8A-8F) illustrate another embodiment. Again, a water play apparatus 160 includes an endoskeleton 162 formed of one or more rigid hollow tubes or pipes (162*a*-162*g*) joined together such as in end to end fashion. The ends 164, 166 of the endoskeleton include joining structures, for example a male joining component at a first end and a female joining component at a second end. One example of mating, joining structures is the use of threaded regions on each end of the endoskeleton portions 162*a*-162*g* that mechanically connect the individual endoskeleton portions together to form a continuous, rigid tube or pipe with a passage extending therethrough. Of course other similar structures for joining the endoskeleton components in end to end relation, and particularly in a watertight manner so that fluid can pass through the passage 168 in the endoskeleton 162, may be used without departing from the scope and intent of the present disclosure.

Once the endostructure portions (e.g., 162*a*-162*g*) are joined, an exoskeleton 170 formed of one or more surrounding portions 170*a*-170*c* surrounds the entire length of the end of structure. Again, the individual exoskeleton portions 170*a*-170*c* are formed from a material that is different, and less rigid than the endoskeleton 162. One preferred materials construction is a foam, such as a polystyrene, that can be preformed portions or components that abut in end-to-end fashion.

Further in the embodiment of FIGS. 7 and 8, a cross bar 210 is formed in a similar manner, i.e., a rigid end of structure is formed from individual endostructure portions 162*f*, 162*g*, 162*h*, and a series of foam disks 220 are interspaced with annular elements 230 that have small passages therethough that are in fluid communication with small openings provided in endostructure portions 162*f*, 162*g* to allow water to exit the water play apparatus at spaced locations along the cross bar 210. Thus, the foam disks 220 and annular elements 230 provide an exoskeleton 170 over the endoskeleton 162. Likewise, a polymer skin 200 (e.g., polyurethane or polyethylene) can be applied over the exoskeleton to provide a thin, smooth, colored (if desired), non-corrosive, watertight surface to the assembly.

Figure 8A:
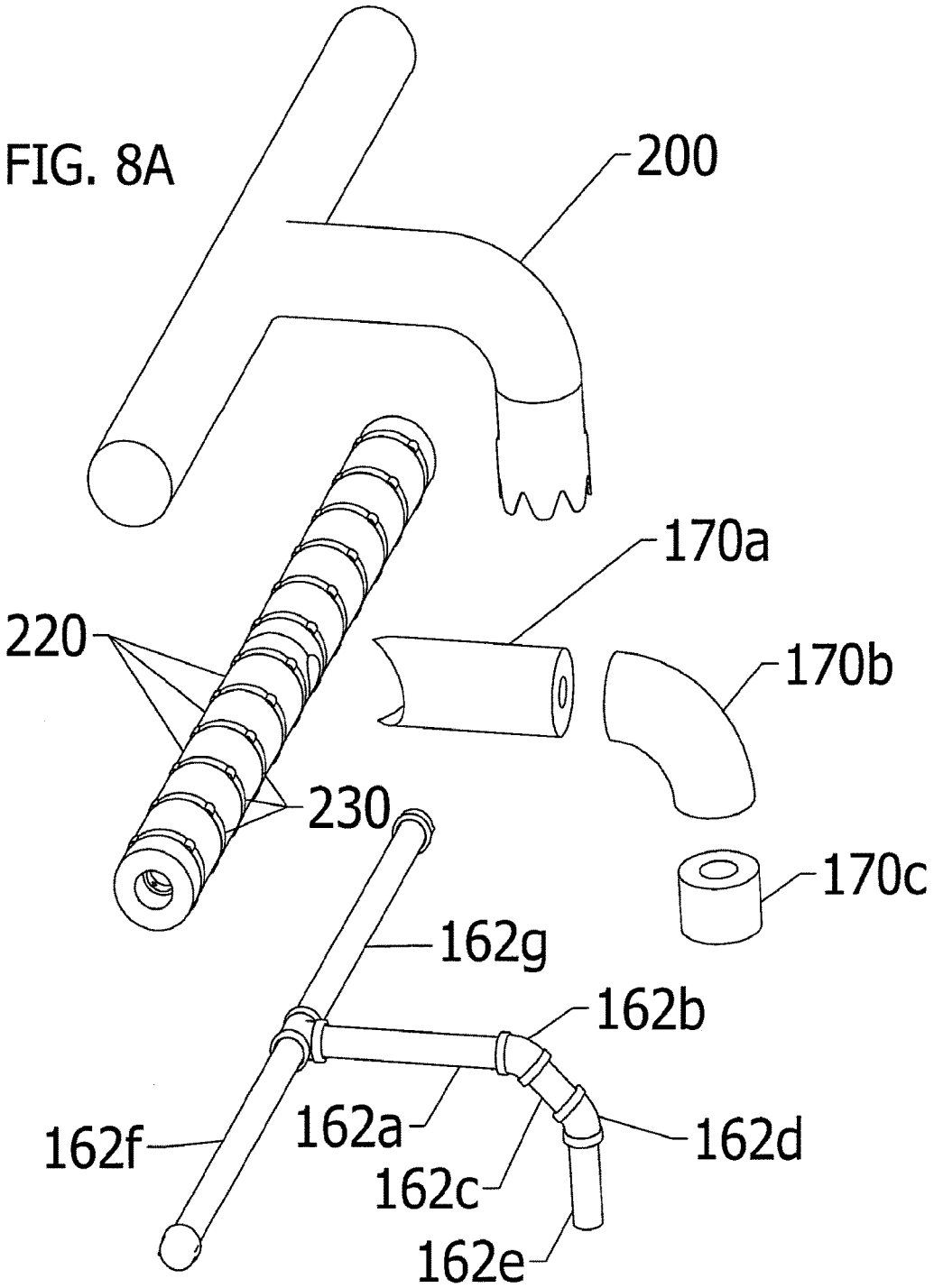
FIG. 8 shows additional details of play apparatus of FIG. 7.
Figure 8B:
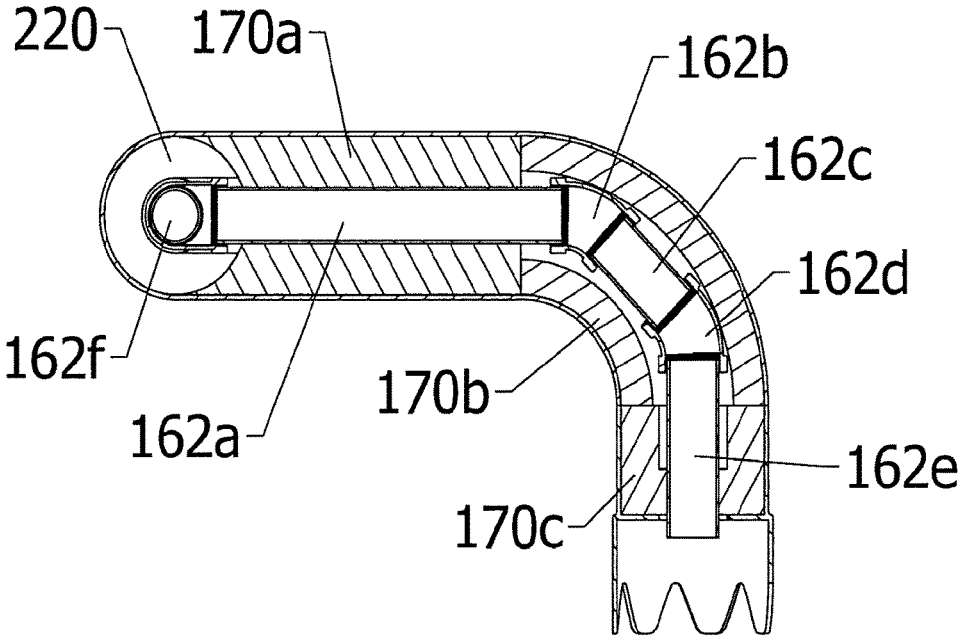
Figure 8C:
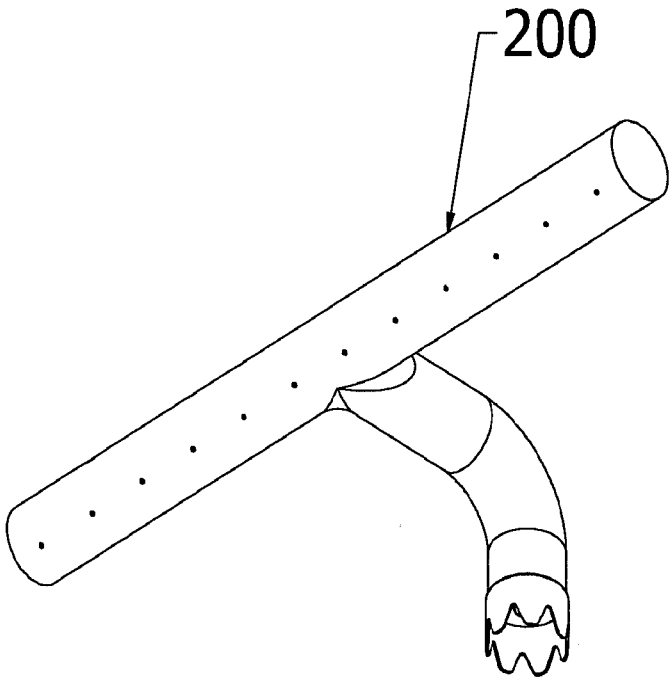
Figure 8D:
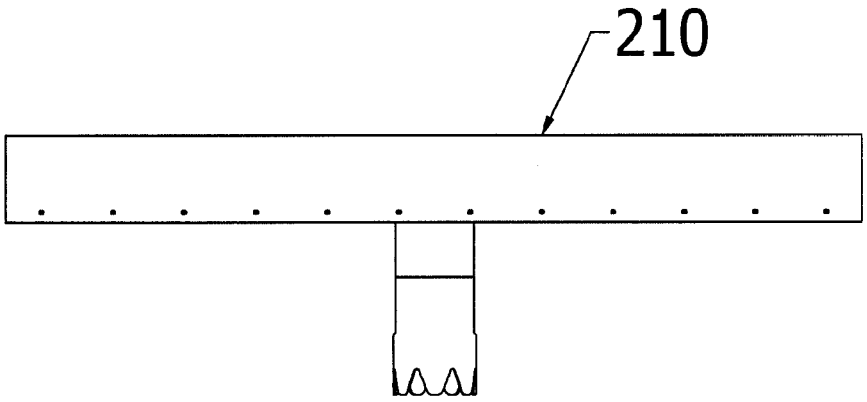
Figure 8E:
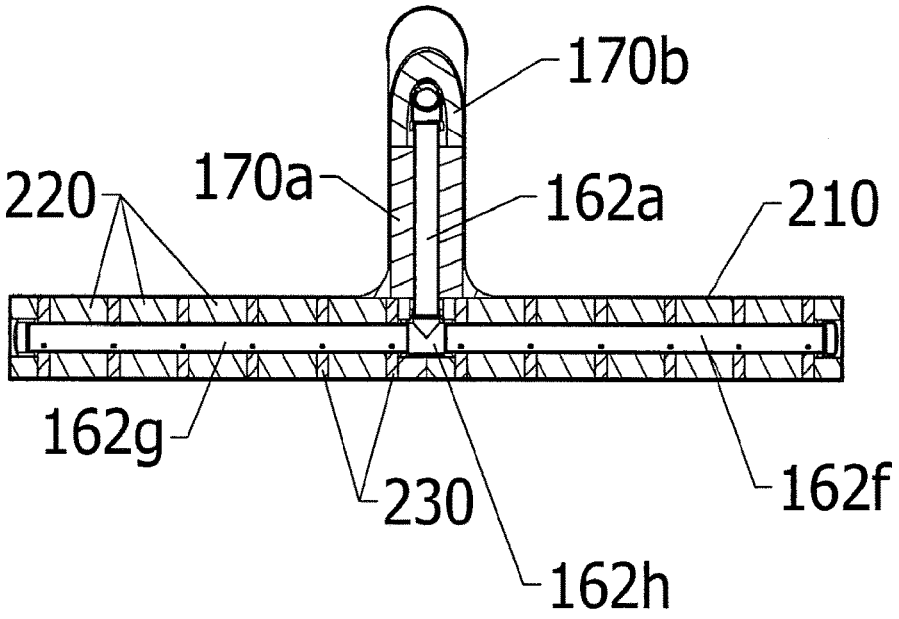
Figure 8F:
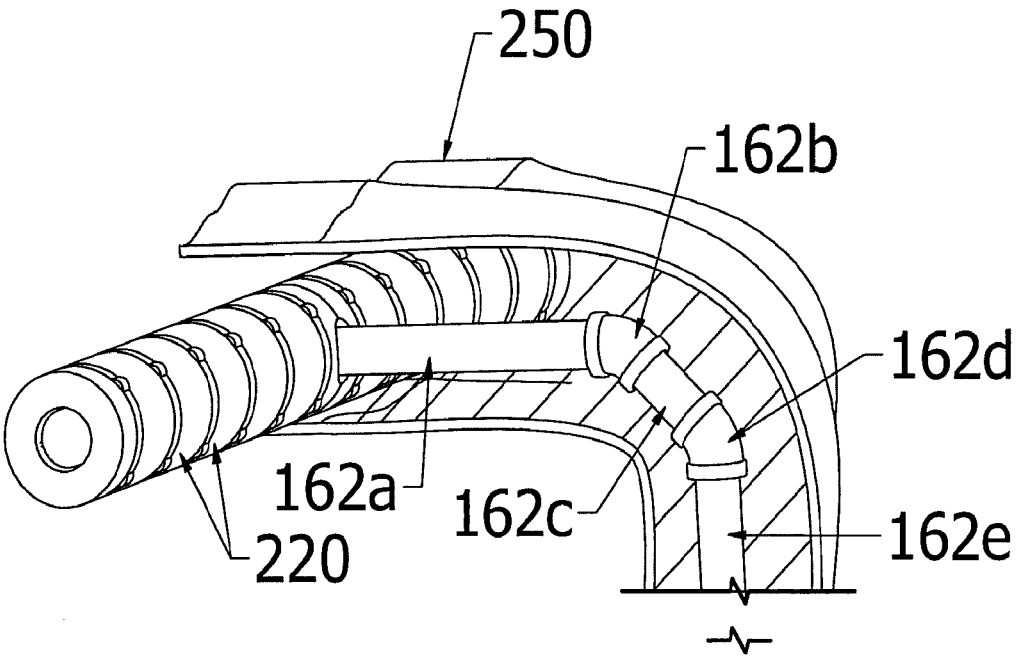

In the embodiment of FIG. 8F, the endoskeleton 162*a*-162*e* is provided as substantially described above. Rather than individual preformed exoskeleton components, however, a mold 250 has an inner surface of a desired shape or configuration. The mold is dimensioned to receive the endoskeleton, and then an exoskeleton is molded in place around the endoskeleton. Again, the exoskeleton is formed of a material that is different from the endoskeleton since the exoskeleton is not intended to the primary weight bearing portion of the assembly since that is the function of the endoskeleton. Instead, the exoskeleton, via the mold cavity and mold walls, can adopt a wide array of shapes, thicknesses, etc. such as the water play apparatus 118, 126, 130, 140, and 150 of FIGS. 1-4. The mold cavity is filled, for example, with a foam (such as polystyrene), and a hardener (e.g., a thin polymer film) is placed over the external surface of the foam. Water is effectively conveyed through the endoskeleton and mates with openings through the exoskeleton to exhibit a number of different spray patterns as may be desired with different water play apparatus.

The endoskeletal frame is encased within corrosion resistant materials to form various shapes, surface textures, mounts, and provide an impact attenuation system. In addition, the structure provides insulation properties that form a nonconductive thermal and electrical barrier.

The elements, segments, and nozzles are provided in various factory configurations to meet project specifications and are interchangeable between factory-configured water play features by the installer, user, or participant.

Various modules can comprise a singular embedded water spray nozzle. By adding additional modules, the assembly transforms the feature into an elevated water feature, and various mounting modules enable various planar surfaces and climbing apparatuses to be added.

The process of manufacturing the elements includes the endoskeletal system encapsulated with a formed or shaped core material, with an elastomeric or polymer material molded to encapsulate the structural and core materials and provide the desired shape.

The exoskeletal elastomeric or polymer system provides structural reinforcement, and the desired aesthetic shapes and forms. The shapes and forms are various representations of any natural or manmade object to inspire creative play.

Various control sensors, valves, spray orifices, nozzles, cameras, and sound devices may be incorporated into the exoskeletal shell and core to provide interactive play or educational benefits to the patron.

The finished surface is completed at the in mold or post mold phase. Various methods and materials applied to the surface are applied for aesthetic appearance, functional purpose, while other coatings are used to detect or react to stimuli.

Numerically controlled machinery, for example, is used to spray form and/or cut foam (e.g., styrofoam) to a desired shape, and a hardener (e.g., polyurethane) is applied to an external surface of the cut-to-shape foam component. Rather than taking approximately 15 to 16 hours from start-to-finish to manufacture a component as is common with the existing fiberglass manufacturing process, spraying/cutting the foam component to shape and substantively applying a hardener takes roughly ½ to 2 hours from start to finish. Preferably, a polyurethane/polyethylene mix is used in the process which also advantageously results in a surface that can be easily painted.

In some instances, a hollow rigid member may also be incorporated in the structural assembly. For example, a hollow stainless steel stem or core can be provided and the foam is received around the core. The polyurethane skin (hardener) is applied over the external surface of the foam.

Ends of the components are adhesively secured to one another, or may include an integral fastening arrangement such as cooperating male and female threads to allow individually formed components to be easily assembled on-site at the spray ground or water park site. The flange is secured to the ground surface around the water supply opening, and the aboveground component is secured to the flange so that the fluid passage formed through the aboveground component communicates with the water supply opening, and the spray, mist, etc. is conveyed and distributed on to the spray ground or water park attendees.

This written description uses examples to describe the disclosure, including the best mode, and also to enable any person skilled in the art to make and use the disclosure. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

The invention claimed is:

1. A water play apparatus comprising:

a hollow, rigid endoskeleton that includes a hollow steel pipe having a fluid passage formed therethrough that provides strength to the water play apparatus to support an associated user;

a base configured to mount the water play apparatus to an associated ground surface of an associated water park, and a first end of the endoskeleton mounted to the base;

an exoskeleton received entirely around the endoskeleton above the associated ground surface and formed from a material different and less rigid than the endoskeleton; and a polymer skin received over the exoskeleton.

2. The water play apparatus of claim 1 wherein the steel pipe is stainless steel.

3. The water play apparatus of claim 1 wherein the exoskeleton includes hollow foam received over the pipe.

4. The water play apparatus of claim 3 wherein the foam includes preformed hollow foam segments.

5. The water play apparatus of claim 4 wherein the foam includes polystyrene.

6. The water play apparatus of claim 1 wherein the polymer skin includes polyurethane.

7. The water play apparatus of claim 1 wherein the polymer skin includes polyethylene.

8. The water play apparatus of claim 1 wherein the endoskeleton includes plural segments that are joined in watertight sealed relation.

9. The water play apparatus of claim 8 wherein the endoskeleton segments include a male joining component at a first end and a female joining component at a second end.

10. The water play apparatus of claim 9 wherein the first and second ends of the endoskeleton segments include threaded regions for mechanically interconnecting adjacent segments.

11. The water play apparatus of claim 1 wherein an interior surface of the exoskeleton abuts against an exterior surface of the endoskeleton.

12. The water play apparatus claim 1 wherein an interior surface of the exoskeleton abuts against an exterior surface of the endoskeleton along at least an entire length of the endoskeleton above ground.

13. The water play apparatus of claim 1 wherein the polymer skin is colored.

14. The water play apparatus of claim 1 further comprising at least one outlet extending through the exoskeleton and the polymer skin that is in fluid communication with the fluid passage in the endoskeleton.

15. The water play apparatus of claim 1 wherein the exoskeleton and the polymer skin are formed from non-corrosive materials.

16. The water play apparatus of claim 1 wherein the exoskeleton and the polymer skin form a nonconductive thermal and electrical barrier.

17. The water play apparatus of claim 1 wherein the exoskeleton is variable in shape along a length of the endoskeleton.

18. The water play apparatus of claim 1 wherein the exoskeleton is an elastomer or polymer molded to and completely encapsulating the endoskeleton.

19. The water play apparatus of claim 1 further comprising at least one of a control sensor, valve, spray orifice, nozzle, camera, and sound device incorporated therein.

20. The water play apparatus of claim 1 wherein an interior surface of the exoskeleton abuts against an exterior surface of the endoskeleton along an entire length of the endoskeleton located above the associated ground surface.

21. The water play apparatus of claim 1 wherein the flange is dimensioned for connection to an associated water supply opening.

* * * * *